United States Patent [19]

Doolittle

[11] Patent Number: 4,984,656

[45] Date of Patent: Jan. 15, 1991

[54] BRACE FOR SCAFFOLDING PLANK

[76] Inventor: Leonard L. Doolittle, 8597 Leatherman Rd., Wadsworth, Ohio 44281

[21] Appl. No.: 524,086

[22] Filed: May 15, 1990

[51] Int. Cl.[5] ..... E04G 5/08

[52] U.S. Cl. ..... 182/222; 182/217

[58] Field of Search ..... 182/222, 223, 217, 218, 182/219

[56] References Cited

U.S. PATENT DOCUMENTS

| | | | |
|---|---|---|---|
| 175,095 | 3/1876 | Hoehn | 182/222 |
| 1,142,955 | 6/1915 | Gaw | 182/222 |
| 2,415,461 | 2/1947 | Causey | 182/222 |
| 2,741,513 | 4/1956 | Dempsey | 182/222 |
| 3,223,370 | 12/1965 | Pignon | 248/141 |
| 3,738,603 | 6/1973 | Arnett | 248/228 |
| 3,854,552 | 12/1974 | Kensrue | 182/222 |
| 3,954,248 | 5/1976 | Barber | 249/211 |
| 4,187,929 | 2/1980 | Cyr | 182/222 |
| 4,558,838 | 12/1985 | Klein | 248/235 |

FOREIGN PATENT DOCUMENTS

| | | | |
|---|---|---|---|
| 405326 | 2/1934 | United Kingdom | 182/222 |

*Primary Examiner*—Reinaldo P. Machado

*Attorney, Agent, or Firm*—Oldham & Oldham Co.

[57] ABSTRACT

The beam deflection resistance of a scaffolding plank is increased by removably positioning at least one secondary plank along the longitudinal axis of the primary plank and securing the secondary planks in position with the brace of the present invention. The brace comprises a closed frame member, having an essentially isosceles trapezoidal cross section. The brace has a first base piece, a second base piece, and two side pieces. The first base piece is essentially as long as the width of the primary plank and has its ends affixed at right angles to the first ends of the two side pieces. The second base piece is essentially as long as the thickness of at least one secondary plank and has its ends affixed to the second ends of the two side pieces. Each side piece has a first and a second straight portion with an obtuse angle formed between said straight portions, the first straight portion being at the first end of said side piece and being at least as long as the thickness of said primary plank, said second portion being at the second end of said side piece and being of proper length and said obtuse angle being of proper angularity to form the isosceles trapezoidal cross section such that the height of said trapezoid is at least equal to the sum of the thickness of said primary plank and the width of said secondary plank.

8 Claims, 2 Drawing Sheets

BRACE FOR SCAFFOLDING PLANK

TECHNICAL FIELD

The present invention relates to a brace for increasing the lengthwise deflection resistance of a plank, particularly one used in a scaffold. More particularly, the present invention relates to a brace for positioning a second plank perpendicularly beneath and against a scaffolding plank, so that a deflection resistant dimension of the second plank bears upon the least deflection resistant dimension of the scaffolding plank, thereby increasing the deflection resistance of the scaffolding plank.

BACKGROUND OF THE ART

The use of scaffolding in the construction trades dates to time immemorial. The purpose of the scaffold is quite elementary. By providing a plurality of spaced vertical support structures, one or more horizontal work surfaces can be positioned adjacent to the construction work so that workers can safely perform their duties. Because the construction trade is an inherently mobile business, it is essential that the elements used in the scaffold be lightweight and portable. It is also essential that they be easily assembled and just as easily disassembled.

A very commonly utilized horizontal work surface in scaffolding applications is the wooden plank. Basically, the plank is cut from wood so that the length dimension of the plank is typically parallel to the longitudinal axis of the tree from which the plank is cut. The other two dimensions of the plank, namely the width and thickness, are characteristic of the particular plank and provide the method for identifying the plank. For example, a plank having a nominal width of approximately 12 inches and a nominal thickness of approximately 2 inches is commonly referred to as a "2×12" board. Similarly, a plank having a nominal width of approximately eight inches and an approximate nominal two inch thickness is called a "2×8." Because the plank can be cut to various sizes along its length dimension, the length dimension is usually not referred to in such characterization, although the planks commonly used in scaffolding will vary from as short as 6 to 8 feet up to as long as 14 to 16 feet. The lower limit is practically set by the resulting requirement for many vertical scaffold supports; the upper limit is set by transportability of the planks.

Due to the growth structure of the wood from which the plank is cut and because of the fact that the normal orientation of the board when used for a scaffolding plank is the width dimension as the horizontal surface, the plank as usually positioned is most vulnerable to beam deformation from the horizontal direction due to loading upon the center of the plank. Such loading occurs not only from the weight of the workers on the plank, but also from the presence of their work materials. An especially serious weight problem is encountered in the masonry industry. In such a case of center loading of a beam or plank, the resulting downward deformation effectively shortens the horizontal span of the beam or plank and increases the angle of the ends with respect to the supports on which it is placed, so that the plank is subject to either breaking or falling off its supports.

As the result of this, users of scaffolds are obliged to shorten the length between the vertical supports, however, thereby increasing the time to assemble and disassemble the scaffolding structure as well as increasing the overall cost of the structure.

SUMMARY OF THE INVENTION

A first object of the present invention is to present a brace for stiffening or increasing the deformation resistance of a plank along its longitudinal dimension.

A second object of the invention is to make such deformation stiffening by use of a second plank that can be engaged upon the lower side of the first plank in an easily assembled and disassembled manner.

A third object of the invention is to enable a scaffolding plank to be reinforced by a variety of different sizes of planks. These and other objectives of the invention are achieved by a brace for increasing the beam deflection resistance of a primary plank by removably positioning at least one secondary plank against said primary plank in a perpendicular relationship, each said plank having dimensions of width, length and thickness, said brace comprising: a closed frame member, having an essentially isosceles trapezoidal cross section, comprising a first base piece, a second base piece, and two side pieces, each said base piece and side piece having respective first and second ends; said first base piece being essentially as long as the width of the primary plank and having its respective first and second ends affixed at right angles to the respective first ends of said two side pieces; said second base piece being essentially as long as the thickness of at least one secondary plank and having its respective first and second ends affixed to the respective second ends of one of said two side pieces; each said side piece consisting of a first and a second straight portion with an obtuse angle formed between said straight portions, said first straight portion being at the first end of said side piece and being at least as long as the thickness of said primary plank, said second portion being at the second end of said side piece and being of proper length and said obtuse angle being of proper angularity to form the isosceles trapezoidal cross section such that the height of said trapezoid is at least equal to the sum of the thickness of said primary plank and the width of said secondary plank. Further objects are obtained by a such a brace wherein the second base piece is adapted with means for removably fastening said secondary plank to said brace. Yet further objects are obtained by such a brace wherein the brace further comprises means for supporting said secondary plank or planks in a perpendicular relationship to said primary plank, particularly wherein said means for supporting comprises a pair of essentially "L"-shaped members having first and second ends, said first ends affixed to the said ends of the second base piece and said second ends affixed along the length of said second straight portion of the adjacent said side piece, such that the "L"-shaped members are positioned internal to the essentially isosceles trapezoidal cross-section.

BRIEF DESCRIPTION OF THE DRAWINGS

The invention will be better understood when reference is had to the following drawings, wherein.

ABSTRACT OF THE DRAWINGS

In the enclosed description of the drawings and in the accompanying drawings, the following letters and numbers are used to indicate the following parts:

is the obtuse angle between side portions 26A and 26B;

H is the vertical height of the brace 20 of the present invention;

L is the length of a plank 10;

T is the thickness of a plank 10;

W is the width of a plank 10;

10 is a generic plank known in the prior art;

12 is a primary plank of the type of plank 10 known in the prior art;

14 is a secondary plank of the type of plank 10 known in the prior art;

20 is a brace of the present invention;

22 is a first base piece of the brace 20;

24 is a second base piece of the brace 20;

26 is a side piece of the brace 20, having first and second portions 26A and 26B, respectively;

30 is an internal means for supporting secondary plank 14, having first and second leg portions 30A and 30B, respectively;

32 is an aperture for fastening secondary plank 14 to brace 20;

40 is a plate;

42 is an aperture in plate 40;

44 is a tightening screw; and

46 is a concavity in plate 40.

DETAILED DESCRIPTION OF THE DRAWINGS

Figure 1:
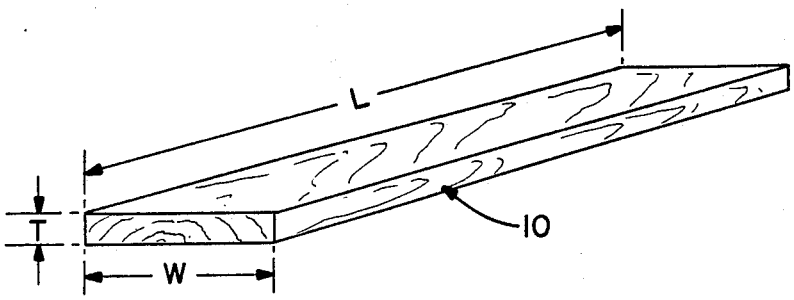
FIG. 1 shows a plank of wood, as known in the prior art.

The type of plank, particularly one of wood, that is known and used in the prior art for scaffolding is shown in perspective in FIG. 1. Such a plank 10 has a width W, a thickness T and a length L. Of these three dimensions, width W and thickness T tend to be characteristic of the plank; and length L is selected by the user and is subject to relative change. In the specific example of using such a plank of wood 10 as a scaffolding plank, it will be typical to find a length L in the range of 6 feet to 16 feet, but it will be appreciated that length L longer or shorter than this can be used and the limits provided are only optimal limits imposed by economics and transportability.

It will be well understood to those of skill in this art that, due to the method by which the plank is cut from the tree from which it is formed, and the relatively thicknesses of the dimensions, that if plank 10 is suspended between supports at the end of its length dimension and the thickness dimension T is exposed to the weight loading, particularly towards the center portion of the plank, the plank will deflect and potentially break. It will also be very clearly understood that if the same beam is supported at the end of its length dimension but, rather the thickness dimension T being exposed to the loading the width dimension W is instead is exposed, the deflection under the same weight will be far less. Unfortunately, the area available as a horizontal work space, also proportionally decreases.

Even further, it will be understood that if the same plank 10 is positioned such that the supports are at the ends of the width dimension and the length dimension is available to bear the weight load, the deflection will be much less, but the available work surface will be reduced even further.

From these it is clearly desirable to increase the resistance to beam deflection of a beam or plank 10 when it is positioned in the first method, that is, the method where supports are at the ends of the length dimension and weight is imposed in the direction of the thickness dimension.

Figure 2:
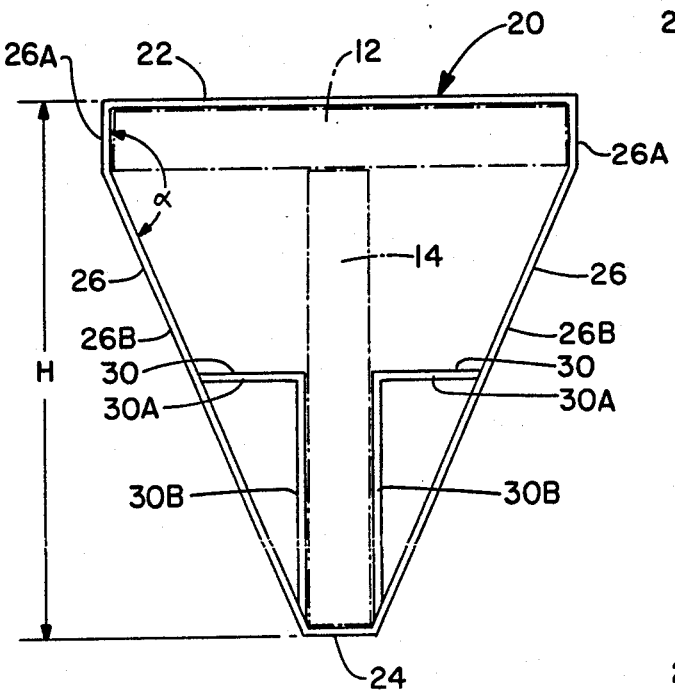
FIG. 2 is a plan view of the present invention, revealing its essentially isosceles trapezoidal cross-section.

A method of increasing the resistance to beam deflection of a first plank 12 by removably positioning a second plank 14 beneath the center of the first plank 12 by an essentially isosceles trapezoidal frame member 20 is shown in FIG. 2.

The bracket 20 has essentially isosceles trapezoidal cross-sectional shape, in which a first base piece 22 is attached to a second base piece 24 which is shorter than the first base piece 22. Affixed to or into grow width the respective ends of the first and second base pieces 22 and 24 are a pair of side pieces 26. Each side piece 26 has two distinct straight portions, indicated as 26A and 26B in FIG. 2. Each respective section 26A and 26B is of a specific length as will be explained further below and the angle between 26A and 26B, as shown by an obtuse angle in FIG. 2, is also set by the particularly use of the bracket 20.

Positioned internally to the trapezoidal shape are a pair of support means 30, shown in FIG. 2 as an essentially L-shaped member comprising the horizontal leg 30A and a vertical leg 30B, positioned at a right angle to each other.

With the overall structure of the trapezoidal frame member 20 in mind, a better understanding can now be had of the size relationships of the parts. The length of the first base piece 22 should be approximately the same length, or slightly longer than, the width dimension W of the primary plank 12 which is to be reinforced by use of the frame member 20. The frame member 20 should be sized such that the width dimension of plank 12 will fit comfortably inside the trapezoidal frame between respective side pieces 26A, which are affixed perpendicularly to first base piece 22. The length of the first side portion 26A should be approximately the same length or slightly longer than the thickness dimension of the plank 12 so that the opposition of first base 22 and the angularity of second side piece 26B will hold the primary plank 12 relatively securely in place. This relatively secure positioning of the primary plank 12 inside the trapezoidal frame structure 20 is independent of the presence of the secondary plank 14. However, it is also desirable to have secondary plank 14 to fit into the trapezoidal structure in a relatively secure manner. For that reason, the relatively height of the trapezoidal frame member 20, that is, the dimension H as shown in FIG. 2, should be such that it is approximately the same as, or slightly larger than, the sum of the thickness dimension T of the primary plank 12 and the width dimension W of secondary plank 14.

The length of second base piece 24 should be such that it is approximately the same length as or slightly larger than the thickness dimension of secondary plank 14. It should be understood in discussing secondary plank 14, however, that it is possible that more than one secondary plank 14 could be used, in which case the length of the second base piece 24 would be approximately the same or slightly larger than the sum of the thicknesses of the secondary plank 14 which would be stacked with their width dimensions adjacent to each other.

With these constraints upon the relative sizes of various pieces, and with the further constraint that the frame member is to have an essentially isosceles trapezoidal cross-sectional area, the relative length of the second side piece 26B and the angularity of obtuse angle $\alpha$ can be easily determined for any given size of primary plank 12 and secondary plank 14. It should be noted that at this point that in many cases the sizes of primary plank 12 and secondary plank 14 may be the same, although this is not necessary or essential to the operation of the invention. All that is necessary for the preparation of the invention is that the bracket 20 that is selected for use should be properly size to accommodate the relative sizes of primary plank 12 and secondary plank 14 when they are positioned in the relatively perpendicular alignment shown in FIG. 2.

The purpose of the essentially L-shape pair of internal members 30 is to further align and position or support the secondary plank 14. It will be understood by one of skill in the art that the function carried out by support means 30 may be carried out by piece 30A alone, piece 30B alone, or, in some cases, the support 30 will not be necessary.

Figure 3:
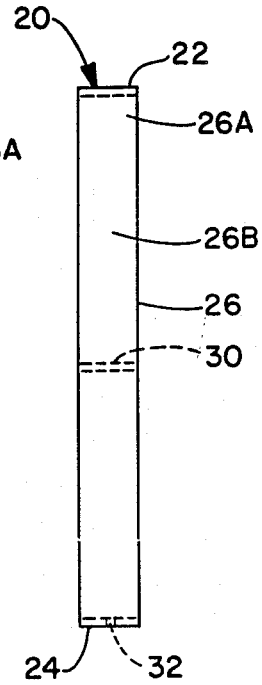
FIG. 3 is a side view of the present invention.

FIG. 3 shows a side view of the present invention 20 to disclose the relative thickness of the bracket 20 viewed perpendicularly to the cross-section disclosed in FIG. 2. It may be readily appreciated that a perspective view of the bracket 20 would disclose the same feature in a similar manner. A further feature which is also shown in FIG. 3 is an aperture 32 which is shown extending through the center of the second base piece 24. The purpose of this aperture 32 is to permit a nail or other fastening means to be driven into the secondary plank 14 once it is positioned to prevent it from slipping or sliding out of the hold of the frame 20.

Figure 4:
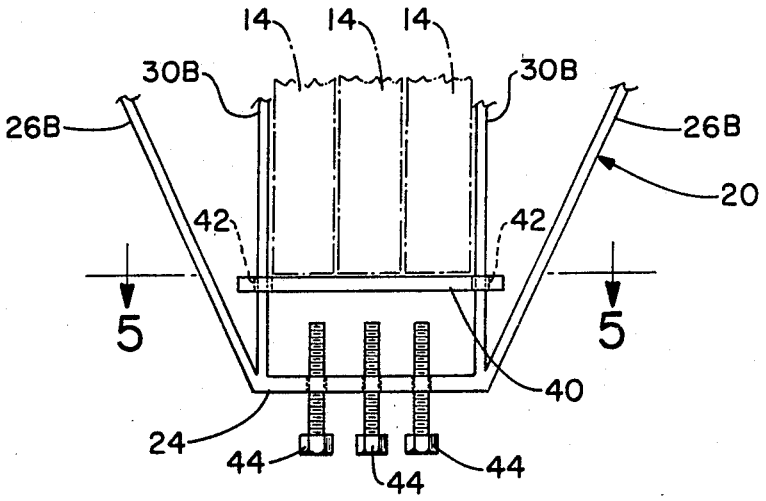
FIG. 4 is a partial view of the lower portion of an alternate embodiment of the present invention.
Figure 5:
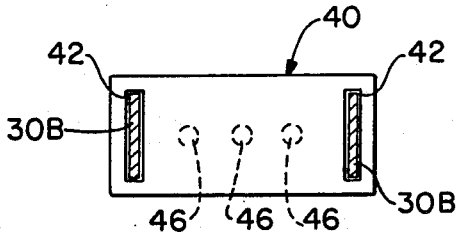
FIG. 5 of the alternate embodiment of FIG. 4, as seen along Line 5—5 therein; and FIG. a perspective view of the present invention in operative engagement with a primary and secondary plank.

A further embodiment of the present invention is disclosed in FIG. 4, which shows a partial view of the lower end of the frame 20. In this view, the secondary support plank 14, shown as a plurality of three such planks, is held in place by a moveable plate 40 which is held in a parallel relationship to the second base plate base piece 24 by the passing of support means 30B through apertures 42 located near the respective ends of support plate 40. In this alternative embodiment, the height H indicated in FIG. 2 would be somewhat larger so that it would clearly exceed the sum of the thickness of the primary plank 12 and the width of the secondary plank or plank 14 so that the planks 14 would be first positioned and then tightened into place by at least one tightening screw 44 which would threadingly pass through plate 24 from the lower side and bear upon the lower side of plate 40.

Viewing the support plate 40 from LINE 5-5 shown in FIG. 4, a further optional feature of the support plate is disclosed. On the side of the support plate facing the tightening screws 44 a number of concavities 46 corresponding to the number of tightening screws 44 are positioned so that, when the tightening screws 44 are tightened to bear upon the lower surface of support plate 40, a concavity 46 to accommodate the end of tightening screw 44 along plate 40 is provided. In this matter, the slippage of tightening screw 44 is minimized.

Just as the first embodiment was shown in FIG. 2 as having a single secondary plank 14 in use and the second embodiment shown in FIG. 4 shows a plurality of three such planks 14, there is no limitation of the separate embodiments, so that a plurality of planks 14 could have been used with the embodiment in FIG. 2 or a single plank 14 could have been used with the second embodiment in FIG. 4.

Figure 6:
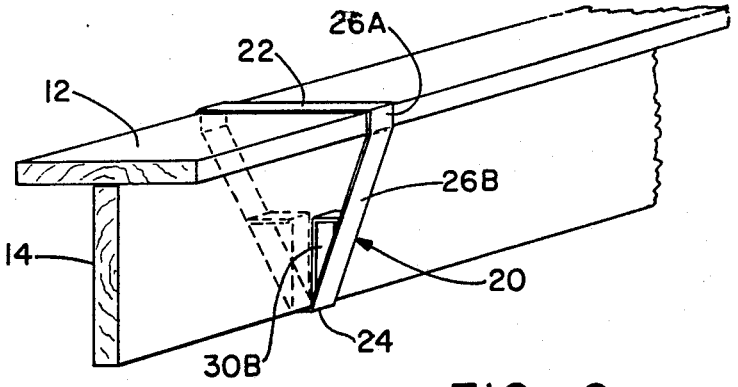

The operative engagement of the bracket 20 of the present invention with scaffolding planks 12 and 14 is illustrated in FIG. 6. In this cut away view the engagement of the relative parts at one end of each such plank 12 is shown. It will be understood that placement of a similar bracket 20 at the other end of plank 12 would be used, and it is conceivable that it may be desirable to use even more than two brackets to securely hold secondary plank 14 beneath the scaffolding plank 12. If such a third or additional bracket 20 were to be used, it would preferable to place it toward the center of the length of the primary plank 12 or another symmetical pattern.

Although the relative thickness of the individual pieces of bracket 20 as shown in FIG. 2 and their relative width in FIG. 3 are not critical to the invention, it will be understood that a preferred method of preparing the invention 20 would be to use steel or similar metal, even more preferably, a barstock being approximately $\frac{1}{8}$" thick and about 2" wide.

Although the preferred material of construction is metal, it is also clear that the invention is not limited by such a material and that a thermoplastic material would indeed be functional for that purpose. One knowledgeable in the formation of metallic pieces will certainly be familiar with the proper methods and location of welding the relative parts of the bracket 20. Similarly, one forming the bracket 20 from a proper thermoplastic material, such as a polycarbonate, polypropylene, or similar material, will be familiar with the molding methods needed and the relative size of the respective pieces.

Referring to FIG. 6 again, then, a method for reinforcing a primary plank 12 by increasing the deflection resistance of the plank has been disclosed. A second plank 14 is positioned centrally beneath the width dimension of the first plank 12 so that the thickness dimension of the second plank 14 bears against the underside of the first plank 12 along the length of the first plank 12. At least two brackets 20 of the present invention are used to hold such second planks I4 in such position.

While in accordance with the patent statutes the best mode and preferred embodiment of the invention has been described, it is to be understood that the invention is not limited thereto, but rather is to be measured by the scope and spirit of the appended claims.

What is claimed is:

1. A brace for increasing the beam deflection resistance of a primary plank by removably positioning at least one secondary plank against said primary plank in a perpendicular relationship, each said plank having dimensions of width, length and thickness, said brace comprising:

a closed frame member, having an essentially isosceles trapezoidal cross section, comprising a first base piece, a second base piece, and two side pieces, each said base piece and side piece having respective first and second ends;

said first base piece being essentially as long as the width of the primary plank and having its respective first and second ends affixed at right angles to the respective first ends of said two side pieces;

said second base piece being essentially as long as the thickness of at least one secondary plank and having its respective first and second ends affixed to the respective second ends of one of said two side pieces;

each said side piece consisting of a first and a second straight portion with an obtuse angle formed between said straight portions, said first straight portion being at the first end of said side piece and being at least as long as the thickness of said primary plank, said second portion being at the second end of said side piece and being of proper length and said obtuse angle being of proper angularity to form the isosceles trapezoidal cross section such that the height of said trapezoid is at least equal to the sum of the thickness of said primary plank and the width of said secondary plank.

2. A brace according to claim 1 wherein the second base piece is adapted with means for removably fastening said secondary plank to said brace.

3. A brace according to claim 1 wherein the brace further comprises means for supporting said secondary plank or planks in a perpendicular relationship to said primary plank.

4. A brace according to claim 1 wherein said means for supporting comprises a pair of essentially "L-"shaped members having first and second ends, said first ends affixed to the said ends of the second base piece and said second ends affixed along the length of said second straight portion of the adjacent said side piece, such that the "L"-shaped members are positioned internal to the essentially isosceles trapezoidal cross section.

5. A brace according to claim 4 wherein a support plate is slidably engaged upon the legs of the "L"-shaped members adjacent to the first ends thereof, said support plate being adjustably spaced from the second base piece by a means for tightening said support plate against said secondary planks.

6. A brace according to claim 1 wherein said brace is comprised of metal bar stock.

7. A brace according to claim 6 wherein the metal bar stock is about ⅛" in thickness and about 2" in width.

8. A method for increasing the beam deflection resistance of a primary scaffolding plank with at least one secondary plank and at least two braces having the limitations recited in claim 1, said method comprising:

positioning at least one said brace near each end of said primary plank, so that the first base piece of said brace securely engages the width dimension of said primary plank and the second base piece of said brace is positioned on the underside and generally centrally beneath said primary plank;

slidingly engaging at least said secondary plank into the respective braces near each end of the primary plank, so that each said secondary plank is positioned perpendicular to said primary plank and bears against the central longitudinal portion of said primary plank; and removable securing each said secondary plank into engagement with said primary plank by means for securing disposed in said second base piece.

* * * * *